United States Patent [19]

Krüger

[11] 4,132,363

[45] Jan. 2, 1979

[54] NOZZLE FOR PRODUCING A WIDE LIQUID JET

[75] Inventor: Max Krüger, Krefeld, Fed. Rep. of Germany

[73] Assignee: Eduard Küsters, Krefeld, Fed. Rep. of Germany

[21] Appl. No.: 794,077

[22] Filed: May 5, 1977

Related U.S. Application Data

[63] Continuation of Ser. No. 650,699, Jan. 20, 1976, abandoned.

[30] Foreign Application Priority Data

Feb. 6, 1975 [DE] Fed. Rep. of Germany ..... 2504856

[51] Int. Cl.[2] ..... B05B 1/04; B05B 1/32

[52] U.S. Cl. ..... 239/455; 239/590.3; 239/593; 239/598

[58] Field of Search ..... 239/193, 451, 455, 590, 239/592, 593, 595, 597, 598

[56] References Cited

U.S. PATENT DOCUMENTS

| | | | |
|---|---|---|---|
| 3,141,194 | 7/1964 | Jester | 239/590.3 X |
| 3,215,152 | 11/1965 | Beerli | 239/455 X |
| 3,272,233 | 9/1966 | Truffitt | 239/455 X |
| 3,360,202 | 12/1967 | Taylor et al. | 239/455 |
| 3,436,022 | 4/1969 | Ernst | 239/455 |
| 3,750,955 | 8/1973 | Nakai et al. | 239/597 X |
| 3,841,557 | 10/1974 | Atkinson | 239/597 X |

FOREIGN PATENT DOCUMENTS

| | | | |
|---|---|---|---|
| 493734 | 6/1954 | Italy | 239/455 |

*Primary Examiner*—Evon C. Blunk
*Assistant Examiner*—Andres Kashnikow
*Attorney, Agent, or Firm*—Kenyon & Kenyon, Reilly, Carr & Chapin

[57] ABSTRACT

A nozzle which produces a wide liquid jet includes a housing open on one side with two longitudinal edges, one of which forms one edge of the nozzle aperture with the other edge of the nozzle aperture formed by the free end of a wall connected to the other longitudinal edge of the housing. Bolts are distributed over the width of the nozzle aperture outside the nozzle aperture for adjusting the wall over the nozzle width to slightly deform the wall and change the thickness of the nozzle aperture.

9 Claims, 7 Drawing Figures

IV
IV
III
III 30
33
31
40
43,44
VI
VI
44
43
42
36
41
32
34
37
39
38
45

NOZZLE FOR PRODUCING A WIDE LIQUID JET

This is a continuation of application Ser. No. 650,699 filed Jan. 20, 1976, now abandoned.

BACKGROUND OF THE INVENTION

This invention relates to nozzles for producing wide liquid jets in general and more particularly to an improved nozzle providing freedom from turbulance and the ability for adjustment.

Nozzles for producing wide liquid jets which have a narrow height or thickness perpendicular to the width of the nozzle and jet direction are known in the art. Typically, such nozzles have a slit-like nozzle aperature extending over the width of a housing with a supply opening provided to the housing at one end through which the liquid is fed to the nozzle. In one nozzle of this type disclosed in German Offenlegunsschrift 2,334,998 the nozzle aperture is defined by two sheet metal edges protruding in the jet direction and held together, against the liquid pressure, by rivets which are distributed over the width of the nozzle slit and disposed transversely to the nozzle aperture. With such a design the rivets pass through the nozzle jet causing local turbulance in the flow. As a result, in certain critical applications, such as in the dyeing of textiles, particularly rugs, color irregularities in the form of streaks can occur. In addition, adjustment of the slit width, once it is established, is not possible.

In view of these difficulties with prior nozzles of this nature, the need for an improved nozzle which avoids turbulance and which is adjustable becomes evident.

SUMMARY OF THE INVENTION

The present invention provides such a nozzle. Starting with a housing to which the liquid can be supplied, and which has two longitudinal edges, the present invention provides a wall having its one end attached to one longitudinal edge with its other, free end along with the other longitudinal edge defining the nozzle aperture. The free edge of the wall is provided with positioning means distributed over the width of the housing which engage the housing and the wall and permit adjusting the thickness of the nozzle aperture. These means are arranged outside the cross sectional area of the nozzle aperture and thus do not create a disturbance in the flow.

The wall which is fastened along one longitudinal edge is substantially firm but has a certain amount of resiliance which permits movement or tilting about the attachment edge. In this manner, the thickness of the jet can be adjusted without the need for slidable or rotatable parts, i.e. parts requiring sealing. Because the positioning means are distributed over the width of the jet, it is possible to vary the thickness to different degrees at different positions. A nozzle of this nature finds particular application in a continuous textile finishing process. When used for this purpose, it has a particular advantage in that, with the nozzle of the present invention, there are no edges projecting into the path of the flow or obstacles interrupting the nozzle jet and textile strands in the liquid cannot catch and accumulate. The prevention of such accumulation and thus, also the development of tresses made up of these threads is important since such material, which becomes bunched up in the nozzle, and is then released when a certain amount builds up, interferes with the succeeding processing such as dyeing or printing of the material and can lead to material which is unsuitable and must be rejected.

The present invention can be implemented in a particularly simple manner through the use of a housing having a U-shaped profile opened on one side and substantially closed by the wall which is attached to one of the legs of the U. The nozzle aperture is formed between the other leg and the free edge of the wall. Displacement of the wall permits variation of the cross section of the nozzle. With an arrangement of this nature it is advisable that the cross section of the chamber in the housing be tapered in a direction away from the opening through which liquid is fed in. The taper prevents a pressure drop which would otherwise occur with increasing distance from the feed opening were the cross section of the chamber constant.

In accordance with another feature of the present invention a limiting wall is provided extending across the width of the housing on the side opposite the wall. The inlet opening opens into the chamber between the limiting wall and the wall forming the nozzle. The limiting wall is tapered so that it approaches the wall forming the nozzle in a direction away from the inlet opening.

In accordance with another embodiment, it is also possible to provide a limiting wall which extends over the width of the chamber on the side opposite the wall forming the nozzle with the inlet opening into the housing between the limiting wall and the rear wall of the chamber. In such a case, the limiting wall is formed with a plurality of overflow openings distributed over its length which lead to the subchamber between the limiting wall and the wall forming the nozzle.

In this embodiment the entire chamber within the housing is divided into two subchambers by means of the limiting wall. Subchambers are located one behind the other with respect to the nozzle aperture. The liquid is first fed into the most remore subchamber then passes through the overflow openings into the subchamber having as its outlet the nozzle aperture. The overflow openings equalize the flow conditions into the front subchamber and thus also equalize the flow condition in the nozzle jet. In accordance with a further modification of this embodiment, a throttle plate is arranged between the wall forming the nozzle and the limiting wall. It extends over the width of the housing and is disposed in front of the overflow openings. It includes means for adjusting its distance from the overflow openings. This permits regulating the exit velocity and output of the nozzle independently of each other. This is an important feature in practical applications. The output is primarily determined by the position of the throttle plate in front of the overflow openings since this controls the amount of liquid passing into the front subchamber directly. The velocity with which this amount flows out of the nozzle aperture depends on the width of the latter which is capable of adjustment by means of its positioning means. Although the one variable has a slight effect on the other variable when changed, the desired combination of exit velocity and output can always be obtained by further adjustment.

In one practical structural design of the nozzle of the present invention, the wall, throttle plate and limiting wall are angled off from the longitudinal edge of the U-shaped chamber which is opposite the nozzle aperture. The bent portions lie on top of each other and are fastened together to the leg of the U opposite the nozzle aperture.

In another embodiment of the present invention provision may be made such that the leg of the U situated at the nozzle aperture is angled off outward and the wall extends substantially parallel to the angled portion up to the point of the bend. In such an embodiment the nozzle aperture is defined by the mutually parallel, lip-like parts of the wall and leg of the U to obtain a particularly good directional effect for the nozzle jet.

In each of the embodiments the positioning members can be threaded bolts arranged outside the wall and operating thereagainst to cause a bending. Because of the small angles involved, slight adjustment of the threaded bolt will result in a considerable displacement of the wall. Thus, a very sensitive adjustment of the thickness of the nozzle jet is possible.

DETAILED DESCRIPTION OF THE PREFERRED EMBODIMENT

FIGS. 1–4 illustrate a first embodiment of the present invention. The overall nozzle is designated generally as 10. It includes a housing 1 having a U-shaped profile opened on the side at which the nozzle aperture 2 is formed. An inlet opening 3 is provided at one end of the housing through which liquid can be supplied over the width thereof. At the opposite end the housing 1 is closed and includes a bearing shaft 4 which is used for supporting the nozzle. As is illustrated particularly well in FIG. 2, the housing, particularly the rear subchamber to be described below, is tapered from the left to the right, i.e. in a direction away from the inlet opening 3, in order to equalize the pressure loss produced by the outflow of the liquid through nozzle aperture 2.

Figures 1, 2, 3, 4:
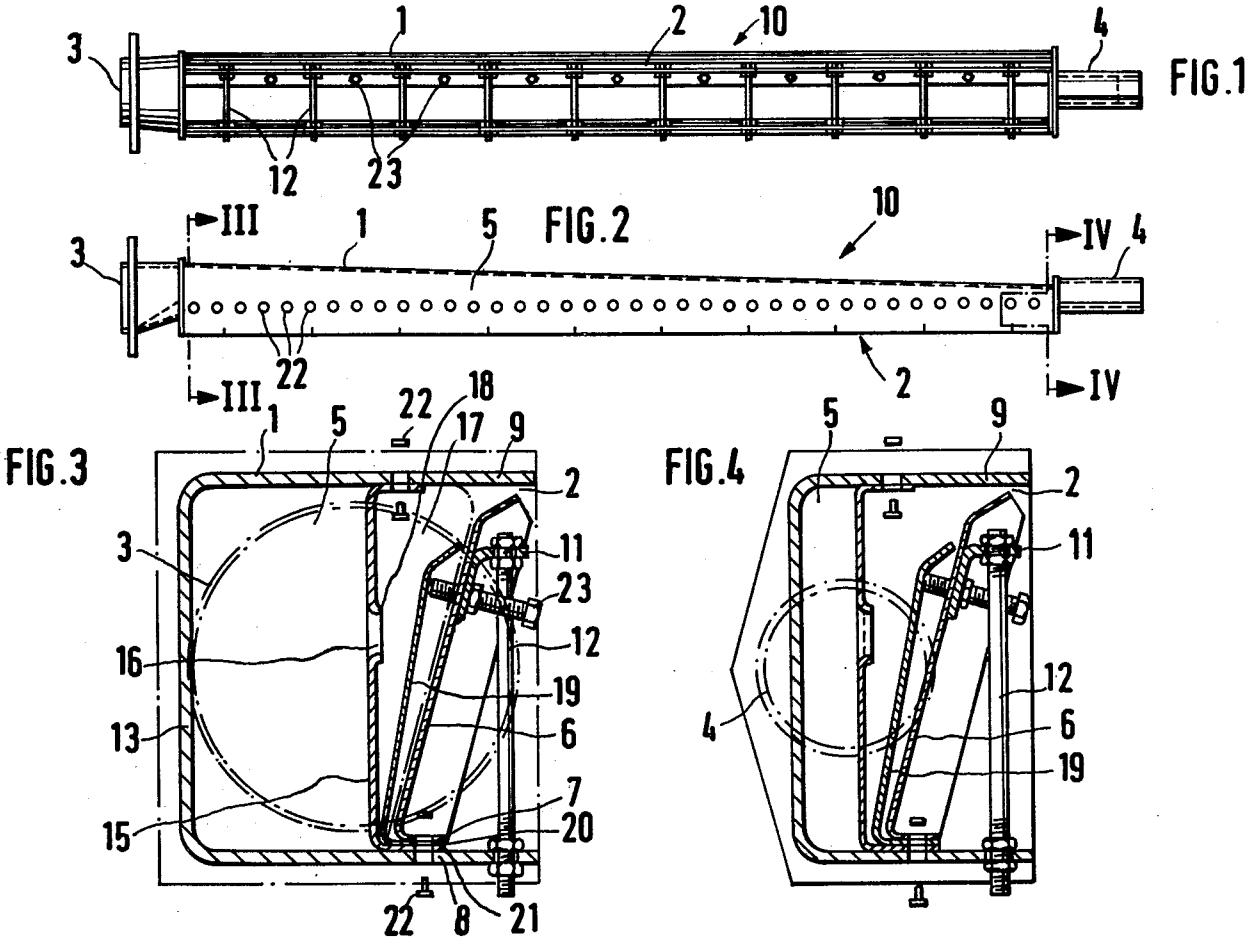
FIG. 1 is an elevation view of a first embodiment of the present invention looking toward the nozzle aperture.
FIG. 2 is a plan view of the embodiment of FIG. 1.
FIG. 3 is a cross sectional view through one end of the embodiment of FIGS. 1 and 2 taken along the line III—III of FIG. 2.
FIG. 4 is a similar view taken along the line IV—IV at the other end of the embodiment of FIG. 2.

The two subchambers within the housing are illustrated in more detail by FIGS. 3 and 4. It can be seen from these views that the rear subchamber 5 is much larger at the end of the inlet opening shown by FIG. 3 than at the opposite end shown by FIG. 4.

The open side of the housing 1 is bounded by a wall 6 which is angled off at its lower edge 7 and tightly connected to the leg 8 of the housing 1. At its free end the wall 6 in cooperation with the other leg 9 of the housing 1 forms the nozzle aperture 2. The wall 6 is not perpendicular to the legs 8 and 9 but is inclined somewhat outward away from the leg 8, i.e. toward the open side of the housing. In the vicinity of the nozzle aperture 2, angle pieces 11 are attached to the wall 6. Coupled between the angle pieces and the leg 8 are a plurality of positioning means in the form of threaded bolts 12. By changing the setting of the threaded bolts 12, the tilt of the wall 6 and, thus, the thickness of the aperture 2 may be changed. Between this wall 6 and the rear wall 13 of the housing 1, a limiting wall 15 is arranged. This extends over the entire width of the housing and forms the two subchambers 5 and 17. It includes a plurality of overflow holes 16 distributed the width of the housing 1. Only the rear subchamber 5 is in communication with inlet opening 3. Thus, liquid flows from the inlet opening 3 to the subchamber 5 and then through the opening 16 into the subchamber 17. From the front subchamber 17 it can then escape through the nozzle aperture 2. The openings or overflow holes 16 are rounded in the manner of nozzles 18 so as to not disturb the flow.

In addition, there is placed between the limiting wall 15 and the wall 6 a throttle plate 19 extending over the entire width of the nozzle 10. The throttle plate 19 is fastened to the leg 8 of the housing 1 at an angle 20. The throttle plate 19, the wall 6 and the dividing wall 15 are all attached to this leg, the dividing wall 15 also having an angled portion at that point, through the use of suitable attachment means 22 or by means of spot welding. The dividing wall 15, as illustrated, is also attached to the other leg 9. The throttle plate 19 is also capable of adjustment. For this purpose, a plurality of threaded bolts 23 are provided passing through the angle 11 and wall 6 to abut against the throttle plate 19. This permits adjusting the distance between the throttle plate 19 and the wall 15 and thus determines the degree of throttling at the overflow holes 16. Thereby, in effect, it controls the amount of liquid which passes from the rear subchamber 5 to the front subchamber 17. This in turn determines how much liquid flows from the nozzle 2. The exit velocity from the nozzle is determined by the cross section of the nozzle aperture 2 which can be controlled by actuating the threaded bolts 12.

While the rear subchamber 5 varies over the width of the nozzle 10, the arrangement of the parts 12, 6, 19 and 15 is approximately the same over the width of the nozzle 10 with respect to cross section so that identical conditions prevail at the nozzle aperture 2.

Figures 5, 6, 7:
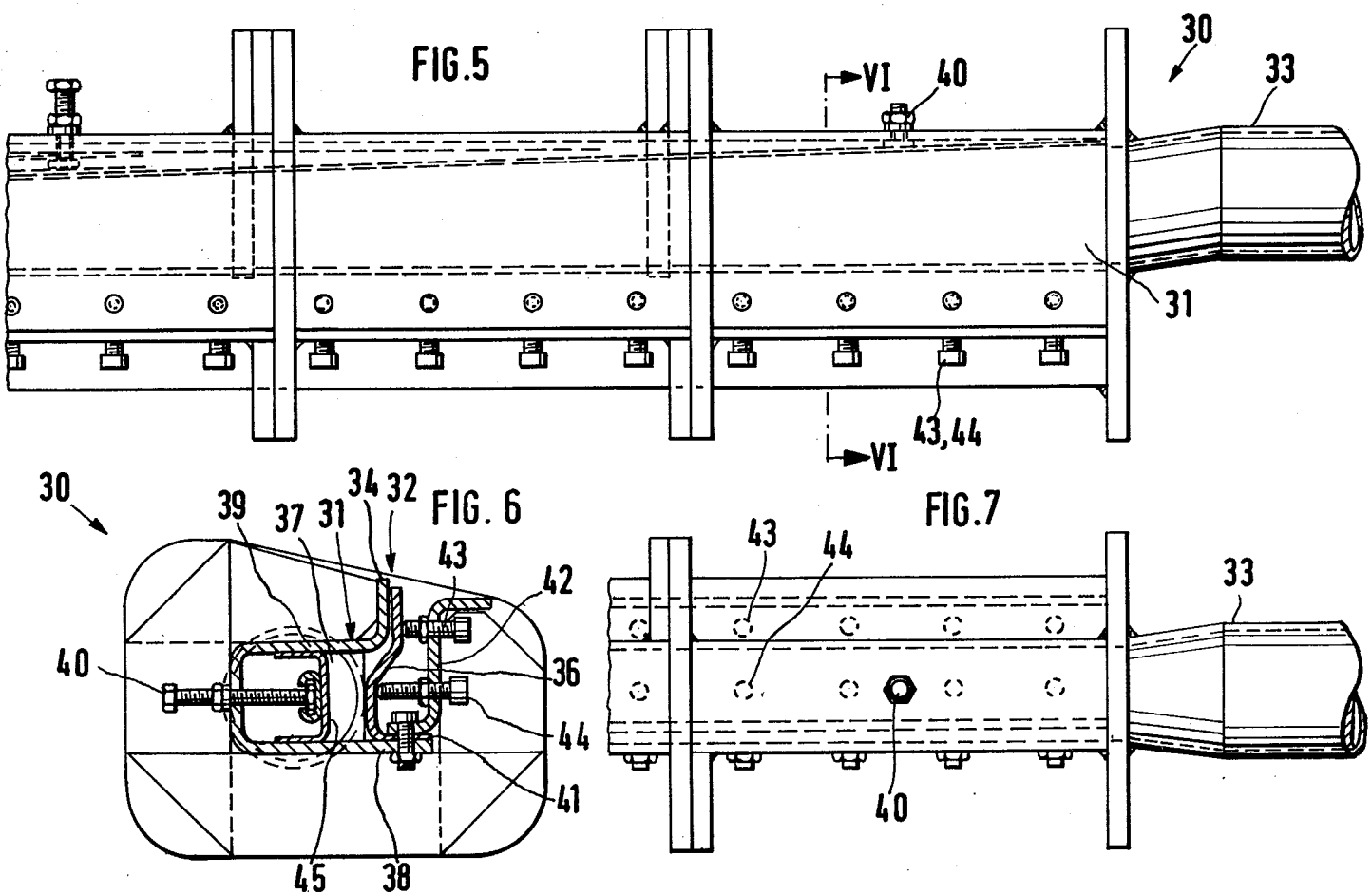
FIG. 5 is an elevation view of a second embodiment of the present invention.
FIG. 6 is a cross sectional view taken along the line VI—VI of FIG. 5.
FIG. 7 is a plan view of a portion of the embodiment of FIGS. 5 and 6.

A further embodiment of the present invention is illustrated by FIGS. 5, 6 and 7. In the nozzle 30 shown thereon, an inlet 33 is provided. In this embodiment liquid flows from right to left. Once again, flow is directed into a U-shaped housing 31. The U-shaped housing has legs 38 and 39 with the outside edge of the leg 39 bent off essentially perpendicular to the remainder of the leg 39 and to the leg 38. This angled portion 34 along with a wall 36 forms the nozzle aperture 32 in this embodiment. In the area of the nozzle 32 the wall 36 is essentially parallel to the portion 34 of the leg 39. Thus, these two approximately parallel nozzle-like parts form the nozzle aperture 32.

In the chamber formed within the housing 31 a limiting wall 45 is disposed having a spacing from the wall 36 which is variable by means of threaded bolts 40. In this manner the front subchamber 37 formed thereby has a taper in a direction away from the inlet opening 33. The wall 36 is fastened to the leg 38 by means of a bent portion 41 as illustrated. Also attached, using the same attachment means e.g. nuts and bolts, are support angles 42. These carry adjusting means 43 and 44 in the form of threaded bolts. These two adjustment means act against the wall 36 at approximately a right angle thereto and influence the width of the nozzle aperture 32 when adjusted, i.e. they tilt the wall 36 about its bent part 41.

This arrangement permits two possibilities for adjustment. In this embodiment, liquid enters from the inlet 33 only into the front subchamber 37. The total amount of liquid can be adjusted by adjusting the limiting wall 45 relative to the wall 46. The width of the nozzle aperture and thus the exit velocity is controlled by adjusting the adjustment means 43 and 44.

Thus, an improved nozzle for producing a wide liquid jet in which no local disturbances are created and in which adjustment is possible has been shown. Although specific embodiments have been illustrated and described, it will be obvious to those skilled in the art that various modifications may be made without departing from the spirit of the invention which is intended to be limited solely by the appended claims.

I claim:

1. A nozzle for producing a wide liquid jet which is narrow perpendicular to its width and jet direction comprising:

(a) a U-shaped housing having a longitudinal rear wall and two longitudinal side legs of equal length extending therefrom, perpendicular thereto terminating in longitudinal edges;

(b) an elongated, essentially planar, first wall having two longitudinal edges, one of said edges rigidly attached to one of said side legs at least near its longitudinal edge, said first wall extending from said one side leg to near the longitudinal edge of the other side leg, the other longitudinal edge of said first wall cooperating with said longitudinal edge of said other side leg to form a nozzle aperture, said first wall made of a single piece of substantially firm material but having sufficient resilience to permit bending;

(c) a plurality of adjusting means distributed over the width of said housing, disposed outside the cross-section of the nozzle aperture, engaging said first wall and permitting tilting thereof about the line of attachment of the edge of said first wall to said one leg for changing the nozzle aperture;

(d) means closing off the ends of said housing to form a chamber bounded by said rear wall, side legs, means closing off and said first wall; and (e) an inlet opening in one of said means at one end of said housing for admitting liquid thereto.

2. A nozzle according to claim 1 wherein the cross section of the chamber formed within said housing is tapered in a direction away from said inlet opening.

3. A nozzle according to claim 2 and further including a limiting wall extending over the width of said housing disposed between said first wall and the rear wall of said U-shaped housing, said inlet opening opening in the chamber formed between said limiting wall and said first wall, said limiting wall arranged at an angle to said rear wall of said housing so that it approaches said first wall in a direction away from said inlet opening.

4. A nozzle according to claim 2 and further including a limiting wall extending across the width of said housing between said first wall and the rear wall of said U-shaped housing, said inlet opening opening into the space between said limiting wall and said rear wall, said limiting wall being provided with a plurality of overflow holes distributed over its width permitting flow from the chamber formed by said limiting wall and said rear wall into the chamber formed by said limiting wall and said first wall.

5. A nozzle according to claim 1 wherein said adjusting means comprise threaded bolts arranged outside said first wall and extending substantially in the direction of said first wall.

6. A nozzle for producing a wide liquid jet which is narrowly perpendicular to its width and jet direction comprising:

(a) a U-shaped housing having a longitudinal rear wall and two longitudinal side legs extending therefrom, essentially perpendicular thereto terminating in longitudinal edges;

(b) an elongated, first wall having two longitudinal edges, one of said edges rigidly attached to one of said side legs, said first wall extending from said one side leg to near the longitudinal edge of the other side leg, the other longitudinal edge of said first wall cooperating with said longitudinal edge of said other side leg to form a nozzle aperture, said first wall made of a single piece of substantially firm material but having sufficient resilience to permit bending;

(c) a plurality of adjusting means distributed over the width of said housing, disposed outside the cross-section of the nozzle aperture, engaging said first wall and permitting tilting thereof about the line of attachment of the edge of said first wall to said one leg for changing the nozzle aperture;

(d) means closing off the ends of said housing to form a chamber bounded by said rear wall, side legs, means closing off and said first wall;

(e) an inlet opening in one of said means at one end of said housing for admitting liquid thereto, the cross section of the chamber formed within said housing being tapered in a direction away from said inlet opening;

(f) a limiting wall extending across the width of said housing between said first wall and the rear wall of said U-shaped housing, said inlet opening opening into the space between said limiting wall and said rear wall, said limiting wall being provided with a plurality of overflow holes distributed over its width permitting flow from the chamber formed by said limiting wall and said rear wall into the chamber formed by said limiting wall and said first wall; and (g) a throttle plate disposed between said first wall and said limiting wall extending over the width of said housing in front of said overflow holes and a plurality of adjusting means distributed over the width of said nozzle for adjusting the distance between said throttle plate and said overflow holes.

7. Apparatus according to claim 6 wherein said limiting wall contains angled portions at each end to give it a U shape, said angled portions being rigidly attached to the legs of said U-shaped housing, said throttle plate also having an angled portion at one end, the angle portion of said throttle plate being secured to the leg of said U-shaped housing opposite said nozzle aperture, together with the angled portion of said dividing wall at said leg, the angled portion of said throttle plate lying on top of the bent portion of said dividing wall.

8. A nozzle for producing a wide liquid jet which is narrow perpendicular to its width and jet direction comprising:

(a) a U-shaped housing having a longitudinal rear wall and two longitudinal side legs of approximately equal length extending therefrom essentially perpendicularly thereto terminating in longitudinal edges, one of said legs bent off outward at an angle of approximately 90°;

(b) an elongated essentially planar first wall having two longitudinal edges, one of said edges rigidly attached to the other of said side legs at least near its longitudinal edge, said first wall extending from said other side leg substantially parallel to said bent portion of said leg at least between its longitudinal edge and the point of bending, the portion of said first wall between its other longitudinal edge and said point of bending cooperating with the bent portion of said one side leg to form a nozzle aperture, said first wall made of a single piece of substantially firm material having sufficient resilience to permit bending;

(c) a plurality of adjusting means distributed over the width of said housing, disposed outside the cross-section of the nozzle aperture, engaging said first wall and permitting tilting thereof about the line of attachment of the edge of said first wall to said one leg for changing the nozzle aperture;

(d) means closing off the ends of said housing to form a chamber bounded by said rear wall, side legs, means closing off and said first wall; and (e) an inlet opening in one of said means at one end of said housing for admitting liquid thereto.

9. A nozzle according to claim 8 wherein said adjusting means are in the form of threaded bolts arranged outside said first wall and acting substantially perpendicular against said first wall.

* * * * *